United States Patent [19]

Winblad

[11] 4,358,984

[45] Nov. 16, 1982

[54] PROTECTIVE DEVICE FOR COMBAT VEHICLE WITH GUN BARREL

[75] Inventor: Nils Winblad, Karlskoga, Sweden

[73] Assignee: Aktiebolaget Bofors, Bofors, Sweden

[21] Appl. No.: 109,734

[22] Filed: Jan. 4, 1980

[30] Foreign Application Priority Data

Jan. 12, 1979 [SE] Sweden ..... 7900277

[51] Int. Cl.[3] ..... F41H 7/02

[52] U.S. Cl. ..... 89/36 H; 89/36 E

[58] Field of Search ..... 89/36 R, 36 A, 36 C, 89/36 D, 36 E, 36 F, 36 G, 36 H, 36 J, 40 B

[56] References Cited

U.S. PATENT DOCUMENTS 295,013 3/1884 Hunter ..... 89/36 E
1,248,325 11/1917 Hayes ..... 89/40 B
1,279,930 9/1918 Stroud ..... 89/36 H

FOREIGN PATENT DOCUMENTS 52644 10/1911 Austria ..... 89/36 E
512305 8/1939 United Kingdom ..... 89/36 D
1073509 6/1967 United Kingdom .

*Primary Examiner*—Stephen C. Bentley
*Attorney, Agent, or Firm*—Pollock, Vande Sande & Priddy

[57] ABSTRACT

In a combat vehicle with a gun barrel extending outside the vehicle a screen for protection against impact-fuzed ammunition is arranged. The protective screen is then arranged to cause the ammunition to be initiated at a distance from the vehicle chassis and to permit certain visibility being maintained from the vehicle for preparedness for firing and for observation.

7 Claims, 4 Drawing Figures

PROTECTIVE DEVICE FOR COMBAT VEHICLE WITH GUN BARREL

TECHNICAL FIELD

The present invention relates to a protective device intended for a combat vehicle, for example a tank, which has a gun barrel extending outside the vehicle. The protective device is intended to protect the vehicle from substantial damage that can arise from impact-fused ammunition directed against the vehicle. The protective device is particularly intended for protection against shells, projectiles, etc. with so-called hollow charge effect, in which cases the shell or the like is made with an internal cone, directed forwards, which at the activation of the bursting charge gives rise to a jet directed forwards which is intended to cut through the vehicle plate. In such a shell or the like, the initiation of the bursting charge is achieved with the aid of electric contact elements in the shell or the like making contact with each other at the impact against the chassis of the vehicle, whereby the shell at the initiation is so close to the vehicle that the effect intended with the jet can be achieved.

DISCLOSURE OF INVENTION

TECHNICAL PROBLEM

For obvious reasons, there is a desire to be able to protect the combat vehicle in question from the ammunition in question. The protective device must then be made in such a way that it is possible to maintain the normal functions of the vehicle, such as preparedness for firing, visibility, etc.

THE SOLUTION

The present invention utilizes the realization of the fact that a great portion of the effect of the ammunition in question is taken away if it can be caused to be initiated even at a comparatively short distance from the vehicle, and also the fact that the ammunition in question is comparatively easily initiated, and can be initiated even at quite light impacts, e.g. in branches and bushes.

In accordance with the concept of the invention, a protective screen is arranged on the gun barrel on the combat vehicle, at its front parts, which protective screen is made in such a way that it achieves an initiation of the shell in question, and also that it is at least partly transparent, so that visibility for firing and observation can be acceptably maintained from the vehicle.

In further developments of the concept of the invention, the screen is arranged so that it can be folded up, and is then made particularly with an umbrella mechanism which is controlled by one or a plurality of hydraulic cylinders or the like. In said further developments, the screen is formed by radially extending elongate rib elements, to which are fastened means, for example in the form of parts of chain, wire, etc., extending between the elements. The elements and the means are so sturdily made that an initiation effect is actually obtained, and with a mesh size which is smaller than the calibre of the ammunition in question.

However, the feature that can mainly be considered to be characteristic of a protective device according to the invention will be noted from the characterizing part of the following claim 1.

ADVANTAGES

Through the proposed design, the effect of the ammunition directed against the vehicle can be reduced substantially, at the same time as the visibility required from the vehicle is maintained. As the weapon can be aimed in elevation and traverse, it is possible to adapt the protection according to judgement or according to indication from central supervision means, which thus makes it possible to protect the vehicle from various directions in dependence on the relative positions of the barrel and the vehicle chassis. The protective device can be of an expendable character, but can also be made easily exchangeable. Spare parts for the protective device can possibly be carried in or on the vehicle.

By arranging the protective screen so that it is collapsible or retractable along the barrel, the screen will not have any detrimental influence on the normal function of the vehicle when the screen is not in use.

BRIEF DESCRIPTION OF DRAWINGS

An embodiment proposed at present of a protective device which has the characteristics significant for the invention will be described in the following, with reference to the accompanying drawings, in which FIG. 1 in perspective and obliquely from above/in front shows a tank which is utilizing the new protective device, FIG. 2 from the side shows parts comprised in the protective device according to FIG. 1 in more detail, FIG. 3 from the side and partly in cross section shows details of the parts according to FIG. 2, the view shown in this figure then being turned 90° in relation to the view according to FIG. 2.

BEST MODE OF CARRYING OUT THE INVENTION

Figure 1:
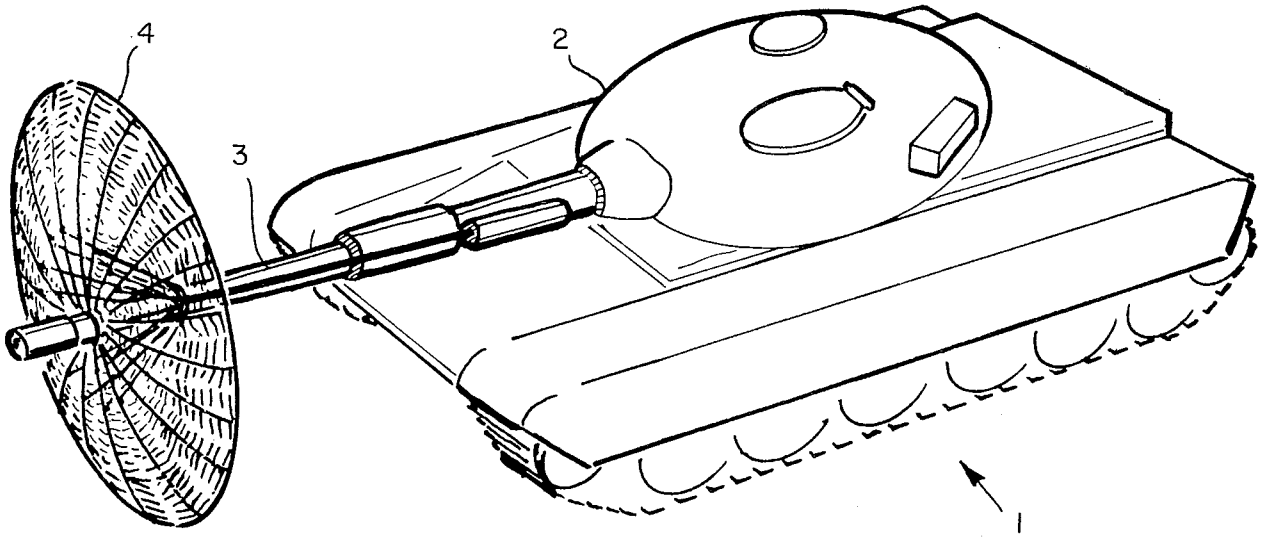

In FIG. 1, a tracked combat vehicle which is conventional in itself is designated by the numeral 1. The vehicle carries an overhead gun 2 with a barrel 3 which extends well beyond the vehicle chassis. At the front parts of the barrel there is arranged a protective screen 4, which is described in more detail in the following. In the example of the embodiment, the protective screen is substantially circular, and in the present case it has a diameter of 2.5–3.0 meters.

Figure 2:
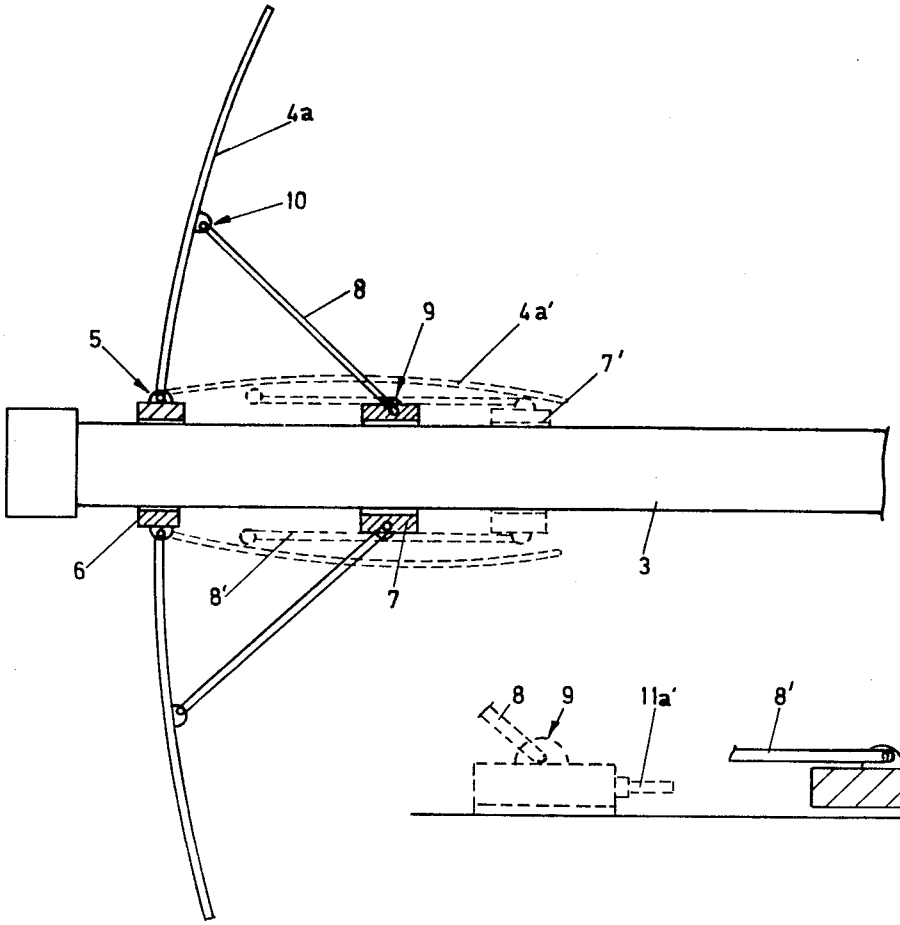

In FIG. 2, for the sake of clearness, only certain parts are shown. The screen comprises a number of elongate rib elements 4*a* made of steel or a corresponding material, extending radially from the barrel 3. At their inner ends, the rib elements are rotatably supported in first rotatable supporting means 5 on a first ring 6, which is secured to the envelope surface of the barrel in a way which is known in itself. The respective first rotatable supporting means can comprise a conventional journal bearing with two side parts with a journal that extends through a hole in the elongate rib element concerned and which is fastened in said side parts. Along the major portion of its longitudinal extent, said elongate rib element can have a profiled cross section which, for example, can have an I or a T shape. The supporting means are moreover made in such a way that the necessary stability is obtained in the first elements and also so that a sufficient number of rib elements can be supported at the barrel.

Said rib elements can be folded out and folded in, and the position in which the screen gives protection is in the completely folded out position. See the solid lines in FIG. 2. The folded-in position for the rib elements has been shown with dash lines, and is indicated by 4a'.

The mechanism for folding the first elements out and in includes a second ring 7, displaceably arranged on the barrel, which can be displaced between the position shown with solid lines and the position shown with dash lines, which latter position has also been indicated by 7' in FIG. 2. Elongate spar elements 8 connect said second ring with the first elements. The spar elements are then support via their first ends in second rotatable supporting means 9 on the second ring and via their second ends in third rotatable supporting means 10 on the first elements, at their middle sections. When the second ring is displaced to the position indicated by 7' the spar elements will be pulled along and will assume the position 8', substantially parallel to the barrel and located inside the rib elements in the folded-in position 4a' for these. Also the elements 8 and the ring 7 are made of metal.

Figure 3:
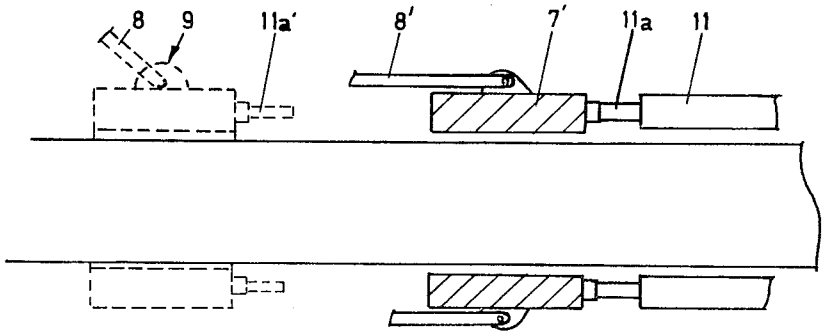

In order to achieve the folding out and in movements in the umbrella mechanism shown, hydraulic cylinders designated 11 of a kind known in themselves are used, in accordance with FIG. 3. In FIG. 3 there are shown two cylinders arranged diametrically on the barrel, which ensure that no tendencies towards coming askew will arise in the umbrella mechanism. In FIG. 3, the ring 7 has been shown with solid lines in its rear position and with dash lines in its front position. The positions of the piston for the hydraulic cylinder have been designated by 11a and 11a'.

Figure 4:
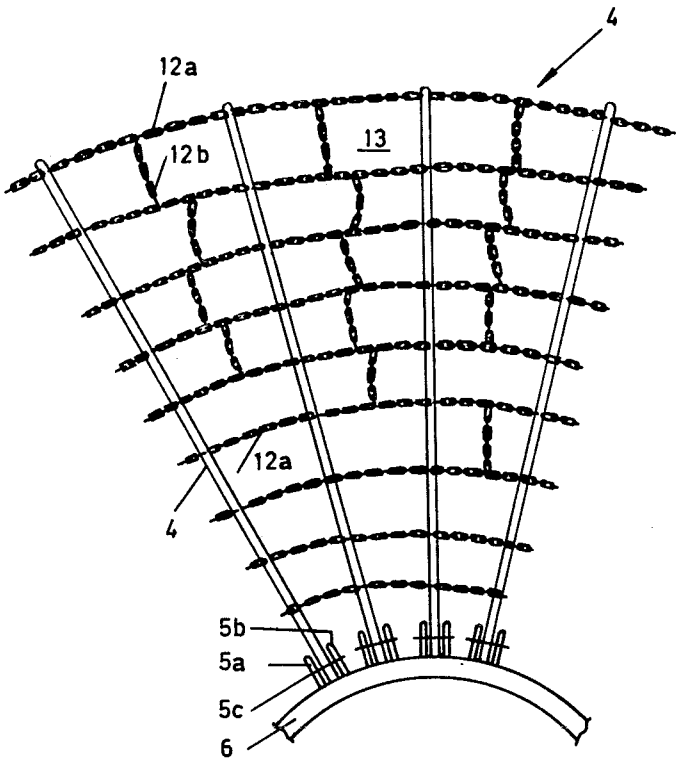
FIG. 4 shows a front view of parts of the protective screen shown in the protective device according to FIG. 1.

In FIG. 4, the screen is partly shown. Between the various radially extending rib elements there are arranged chain parts 12a which at their ends are fastened at different radial distances to the rib elements, which are then utilized to the maximum. The chain parts 12a, in turn, can be connected to each other with further chain parts 12b, in order that the chain parts together shall form meshes 13 of a size which is smaller than the calibre of the ammunition against which the screen is to give protection. At their outer links, the chain parts 12a are secured in holes, through welding, etc., to the rib elements. The elements and the chains are made so that the necessary mechanical strength is obtained in the screen and the parts belonging to it, and so that the screen will also be capable of initiating projectiles directed against the vehicle. I or T beams with a height of 30–50 mm and chain sizes of approx. 25 mm can be considered to fulfil the requirements very well.

In FIG. 4, the side parts of the first rotatable supporting means 5 have been shown by 5a and 5b, and the journal has been symbolized by 5c. The second and third rotatable supporting means are designed in the corresponding way as the first rotatable supporting means.

The outer diameter of the screen is dependent on the length of the barrel. The longer the barrel extends from the vehicle, the smaller the diameter of the screen need be used, and vice versa. The size of the screen is also determined by the width and height of the vehicle. The permissible size of the screen is moreover determined by the space required for folding in the screen, i.e. the folding radius must go clear of the vehicle body.

In order to facilitate the mounting and removal of the protective device on the vehicle during field service, the first and second rings, respectively, can each be made in two halves, which are easily assembled. Some of the chain parts can be made so that they can be hooked on in open recesses in the first elements, so that also the screen will be divisible, in principle, into two halves.

The invention is not limited to the embodiment shown above as an example, but can be subject to modifications within the scope of the following claims.

INDUSTRIAL APPLICABILITY

The new protective device is composed of parts which are suitable for manufacture and assembly in a factory. The design is also adapted so that mounting on the vehicle in question and removal can easily take place during field service.

I claim:

1. An extendable and retractable screen to be mounted on a gun barrel which extends beyond the armor of an armored combat vehicle, the screen and the armor thereby providing two distinct overlying layers of protection for the occupants of the combat vehicle, the screen igniting impact fused ammunition with shaped or hollow charge effects, said screen igniting said ammunition at a distance from the armor of the vehicle to provide dissipation of the charge before it reaches the armor, the armor of the vehicle then protecting the occupants of the vehicle from the dissipating charge, said retractable screen comprising:

(a) an enlarged protective screen surrounding a substantial portion of said gun barrel, said screen having a mesh spacing to provide a field of view therethrough for the occupants of the vehicle, said screen igniting impact fused ammunition with shaped or hollow charge effects which strike said screen, (b) securing means mounted on said barrel, said means having a first fixed ring and second slidable ring, said first ring surrounding and fixably secured to said gun barrel, said second ring slidably mounted on said gun barrel, (c) extendable and retractable support means for said protective screen, said support means including a plurality of circumferentially spaced rib members pivotably attached to said first fixed ring, said support means also including a plurality of circumferentially spaced spar members, each one of said spar members being pivotably mounted and extending from said second slidable ring to an intermediate portion of one of said support ribs, operating means mounted on said gun barrel, said means including at least one hydraulic cylinder for selectively adjusting the slidable ring with respect to the fixed ring to thereby extend and retract the support means for the protective screen between a fully extended position wherein each rib extends outwardly from said gun barrel, and a fully retracted position wherein each rib extends substantially parallel to said gun barrel.

2. An extendable and retractable screen as claimed in claim 1, wherein said ribs define portions of the mesh of said screen, with circumferentially and radially spaced strips defining the remainder of said screen.

3. An extendable and retractable screen as claimed in claim 2 wherein said strips are substantially 25 mm in diameter.

4. An extendable and retractable screen as claimed in claim 2 wherein said strips are formed of chain.

5. An extendable and retractable screen as claimed in claim 2 wherein said strips are formed of wire.

6. An extendable and retractable screen as claimed in claim 2 wherein said operating means further comprises two hydraulic cylinders mounted on opposite sides of said gun barrel between said armor and said slidable ring.

7. An extendable and retractable screen as claimed in claim 2 wherein said screen and said securing means are formed in halves to facilitate a field installation of said retractable screen.

* * * * *